US007370845B2

(12) United States Patent
Kondo

(10) Patent No.: US 7,370,845 B2
(45) Date of Patent: May 13, 2008

(54) THROTTLE BODY FOR TWO-WHEELED VEHICLE

(75) Inventor: Yasushi Kondo, Kawasaki (JP)

(73) Assignee: Keihin Corporation, Tokyo (JP)

( * ) Notice: Subject to any disclaimer, the term of this patent is extended or adjusted under 35 U.S.C. 154(b) by 76 days.

(21) Appl. No.: 11/447,845

(22) Filed: Jun. 7, 2006

(65) Prior Publication Data

US 2006/0273472 A1 Dec. 7, 2006

(30) Foreign Application Priority Data

Jun. 7, 2005 (JP) ..... 2005-166460

(51) Int. Cl.
*F02M 19/03* (2006.01)

(52) U.S. Cl. ..... 261/23.2; 123/470; 261/115; 261/116; 261/118

(58) Field of Classification Search ..... 261/23.1, 261/64.1, 115, 116, 118, 23.2; 123/470
See application file for complete search history.

(56) References Cited

U.S. PATENT DOCUMENTS 2,986,131 A * 5/1961 Larsen ..... 123/336
3,572,656 A * 3/1971 Oshima ..... 261/23.2
3,575,391 A * 4/1971 Braun et al. ..... 261/64.1
3,758,082 A * 9/1973 Kertell ..... 261/23.2
3,943,906 A * 3/1976 Hirose et al. ..... 123/179.16
4,073,278 A * 2/1978 Glenn ..... 123/198 F
4,132,203 A * 1/1979 Elpern et al. ..... 123/472
4,149,496 A * 4/1979 Palma ..... 123/470
4,325,341 A * 4/1982 Yamauchi et al. ..... 123/472
4,347,823 A * 9/1982 Kessler et al. ..... 123/472
4,415,507 A * 11/1983 Voliva ..... 261/18.3
2004/0237934 A1* 12/2004 Tsukui et al. ..... 123/336
2005/0104234 A1* 5/2005 Goto ..... 261/40

FOREIGN PATENT DOCUMENTS

GB 2027488 A * 2/1980 ..... 123/470
JP 2808920 7/1998
JP 3049576 B2 * 3/2000

* cited by examiner

*Primary Examiner*—Richard L. Chiesa
(74) *Attorney, Agent, or Firm*—Bacon & Thomas PLLC

(57) ABSTRACT

To shorten a side mounting pitch of adjacent throttle bodies, in a multiple throttle body, thereby improving a mounting property to a two-wheeled vehicle, a discharge open hole (5) and a fuel spray escaping hole (7) are continuously provided toward a suction air passage (2*a*) in a downstream side of a throttle valve (4), longitudinal axes (X-X) of the respective throttle valve shafts (3,3) are coaxially arranged, a plurality of throttle bodies (1) are arranged in a side direction, an engine side mounting pipe sleeve (10) formed in an outer periphery of the downstream side suction air passage (2*a*) including at least the fuel spray escaping hole (7) and the engine side end surface (1*a*) is formed in an oval or an elliptic shape, and short axis portions (10*a*) of the oval or the elliptic shape are arranged along the longitudinal axis (X-X).

1 Claim, 3 Drawing Sheets

THROTTLE BODY FOR TWO-WHEELED VEHICLE

BACKGROUND OF THE INVENTION

1. Field of the Invention

The present invention relates to a fuel injection apparatus in which fuel within a fuel tank is boosted by a fuel pump, and the boosted fuel is injected and supplied to an engine via a fuel injection valve attached to a throttle body, and more particularly to a throttle body for a two-wheeled vehicle provided with a fuel injection valve preferably used for the two-wheeled vehicle.

2. Description of the Conventional Art

A description will be given of a conventional throttle body for a two-wheeled vehicle with reference to FIGS. 2 and 3.

Reference numeral 1 denote a throttle body in which a suction air passage 2 is provided so as to pass through an inner portion. The suction air passage 2 is opened and closed by a butterfly type throttle valve 4 attached to a throttle valve shaft 3 which is rotatably supported to the throttle body 1 across the suction air passage 2.

The suction air passage is sectioned into a downstream side suction air passage 2*a* and an upstream side suction air passage 2*b* by the throttle valve 4. The downstream side suction air passage 2*a* is connected to an engine by a suction air pipe (not shown) or the like, and the upstream side suction air passage 2*b* is connected to an air cleaner (not shown). Accordingly, a foreign material is removed by the air cleaner, and a clean air in which an amount is controlled by the throttle valve 4 is supplied to the engine via the suction air pipe.

On the other hand, a fuel injection valve J is attached to an outer periphery of the throttle body 1.

The fuel injection valve J is structured such that a valve body opens and closes an injection hole Jb open to a leading end portion Ja on the basis of a current application to a coil in an inner portion and a current shutting, thereby injecting the boosted fuel from the injection hole Jb in a vapor form, as has been known from Japanese Patent No. 3049576 or the like.

The fuel injection valve is obliquely arranged at an acute angle with respect to a longitudinal axis Z-Z of the suction air passage 2, the leading end portion Ja thereof is inserted to a discharge opening hole 5 provided in the throttle body 1, the rear end portion Jc thereof is inserted to a fuel distribution pipe 6 screwed into the throttle body 1, and the fuel injection valve J is held by the throttle body 1 and the fuel distribution pipe 6 in this state. This is executed by screwing a collar portion 6*a* of the fuel distribution pipe 6 to the throttle body 1.

The discharge opening hole is open to the suction air passage 2*a* in the downstream side of the throttle valve 4 from a lower side, and a fuel spray escaping hole 7 is continuously provided toward an engine side end surface 1*a* of the throttle body 1 from the discharge opening hole 5. The fuel spray escaping hole 7 is necessary for supplying a vapor-formed fuel Jd injected from the injection hole Jb of the fuel injection valve J into the suction air passage 2*a* with an improved vapor form without coming into collision with the other elements.

In accordance with the structure mentioned above, the discharge opening hole 5 and the fuel spray escaping hole 7 are formed and opened so as to face to a lower position of the suction air passage 2*a* in the downstream side of the throttle valve 4.

In the two-wheeled vehicle, the throttle body 1 mentioned above is duct-connected by the suction air pipe (not shown) and a tubular rubber mount 8 (shown by a single-dot chain line in the drawing), and an upstream side of the rubber mount 8 is fitted to an engine side mounting pipe sleeve 9 of the throttle body 1 formed in the outer periphery of the suction air passage 2*a* in the downstream side than the throttle valve 4.

Further, the engine side mounting pipe sleeve 9 is formed in the throttle body 1 including the discharge opening hole and the outer periphery of the fuel spray escaping hole 7, and is formed in a complete round shape having a radius R on the basis of a center 9*a* which is eccentrically arranged at a distance a downward from a center Za of the suction air passage 2 formed in a complete round shape.

The above structure can be understood by FIG. 3.

The single throttle body 1 is provided with the fuel injection valve J formed in the manner mentioned above, and a multiple throttle body is formed by arranging a plurality of the throttle bodies 1 in a side direction at a fixed mounting pitch. At this time, longitudinal axes X-X of the respective throttle valve shafts 3, 3, . . . in the respective throttle bodies 1, 1, . . . are coaxially arranged in the side direction in the drawing. (This structure is shown in FIG. 4, and four axes are arranged in the side direction.)

Further, coupling levers 11*a* and 11*b* are attached to facing end portions 3*a* and 3*b* of the respective throttle valve shafts 3 and 3 in the adjacent throttle bodies 1 and 1, and the coupling levers 11*a* and 11*b* are synchronously connected by a synchronizing mechanism 12 such as a synchronizing screw or the like.

A specific structure of the synchronizing mechanism 12 is omitted for clarifying the drawing, however, is provided with a mechanism of synchronously rotating the adjacent throttle valve shafts 3 and 3 and adjusting opening degrees of the throttle valves 4 and 4 attached to the respective throttle valve shafts 3 and 3 to an identical opening degree.

In other words, the respective throttle valve shafts 3, 3, . . . of the respective throttle bodies 1, 1, . . . are synchronously rotated by the coupling levers 11*a* and 11*b* and the synchronizing mechanism 12, and the opening degrees of the respective throttle valves 4 attached to the respective throttle valve shafts 3, 3, . . . are synchronously controlled to the identical opening degree.

SUMMARY OF THE INVENTION

In accordance with the conventional throttle body for the two-wheeled vehicle mentioned above, since the engine side mounting pipe sleeve 9 is formed in the complete round shape so as to be eccentric downward than the center Za of the suction air passage 2, the following problems are caused.

First, since the thick portion 1*b* (particularly shown by a diagonal dotted line in FIG. 3) is formed between the lower portion of the suction air passage 2 and the engine side mounting pipe sleeve 9, a blow hole tends to be produced in this portion at a time of injection molding of the throttle body 1 by an aluminum die casting material and an inspection process is increased.

Further, since a weight is increased, a workability is deteriorated at a time of a production process, and the increased weight is not preferable particularly for middle or small sized two-wheeled vehicles.

Further, since a material cost is increased, it is impossible to achieve a reduction of a manufacturing cost.

Secondly, it is impossible to effectively shorten a side mounting pitch P between the adjacent throttle bodies 1 and 1.

In other words, since the coupling levers 11*a* and 11*b* and the synchronizing mechanism 12 are arranged in the facing portions of the adjacent throttle bodies 1 and 1, a gap L is required between the facing side surfaces 9*a* and 9*b* of the respective engine side mounting pipe sleeves 9 and 9 of the adjacent throttle bodies 1 and 1.

In accordance with the structure mentioned above, the side mounting pitch P between the adjacent respective throttle bodies 1 and 1 is formed by a sum of a radius R of the engine side mounting pipe sleeve 9 of the first throttle body 1 in a leftmost side in FIG. 4, a gap L between the facing side surfaces 9*a* and 9*b* between the first throttle body 1 and the second throttle body 1 in the right side thereof, and a radius R of the engine side mounting pipe sleeve 9 of the second throttle body 1.

In other words, the side mounting pitch P of the adjacent throttle bodies 1 and 1 is expressed by R+L+R.

Accordingly, the side mounting pitch length in the four-train throttle body shown in FIG. 4 is expressed by (3×P) Accordingly, a total width W of the throttle body along the throttle valve shaft 3 of the four-train throttle body becomes longer, and at a time of arranging the multiple throttle body approximately orthogonally to the forward moving direction, particularly in the two-wheeled vehicle, a mounting property is deteriorated, and a freedom of layout is obstructed.

A multiple throttle body for a two-wheeled vehicle in accordance with the present invention is made by taking the problems mentioned above into consideration, and an object of the present invention is to shorten a side mounting pitch of adjacent throttle bodies and shorten a total width along a longitudinal axis of a throttle valve shaft of the multiple throttle body, thereby improving a mounting property to the two-wheeled vehicle and a freedom of layout, and to reduce a thick portion of the throttle body particularly formed between a suction air passage and an engine side mounting pipe sleeve so as to reduce a weight and a material cost, thereby improving a molding property at a time of injection molding the throttle body and achieving an improvement of a productivity and a reduction of a manufacturing cost, in the multiple throttle body.

DETAILED DESCRIPTION OF PREFERRED EMBODIMENT

Figure 1:
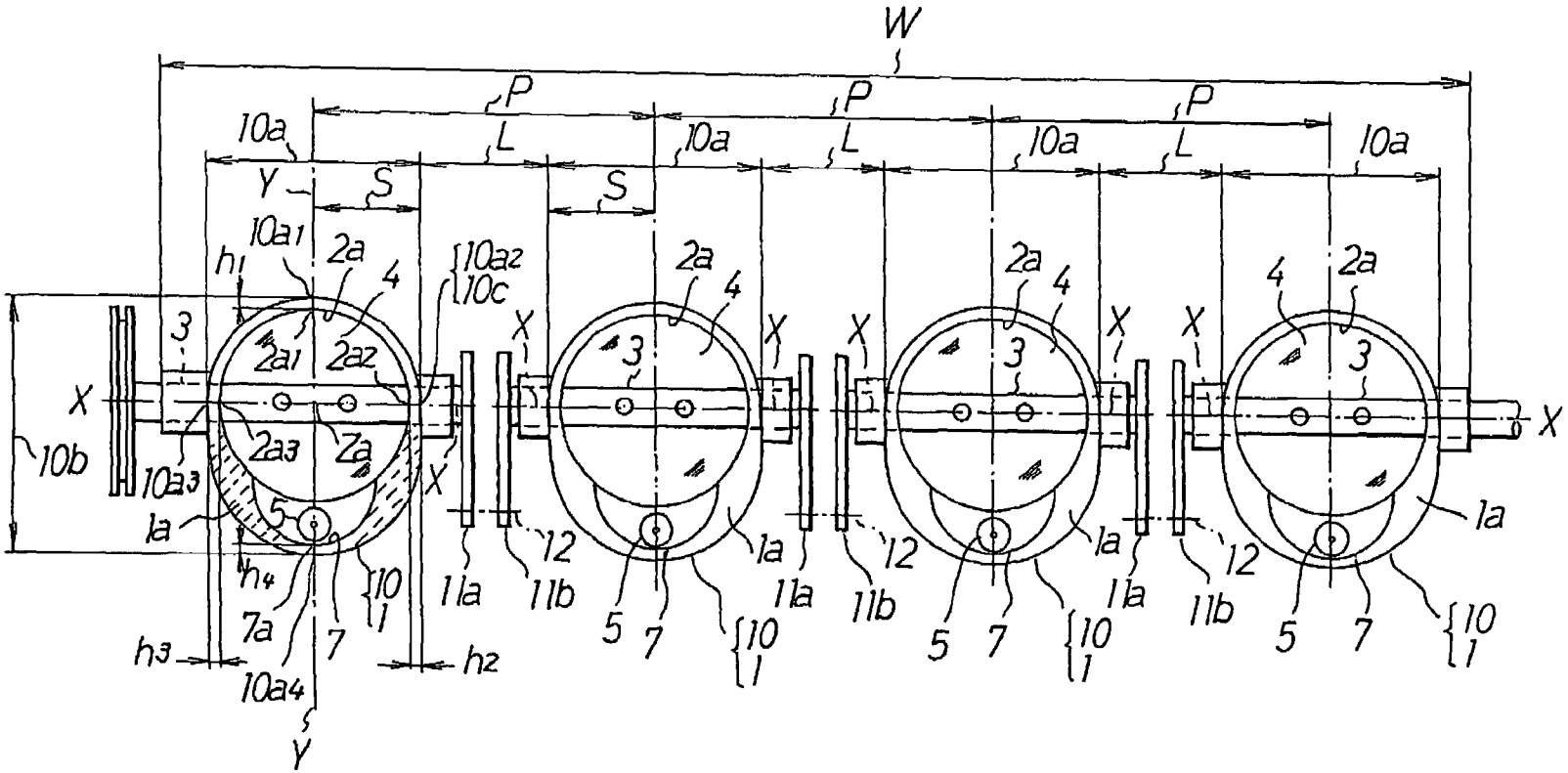
FIG. 1 is a side view of a main portion showing an embodiment of a multiple throttle body for a two-wheeled vehicle in accordance with the present invention.
Figure 2:
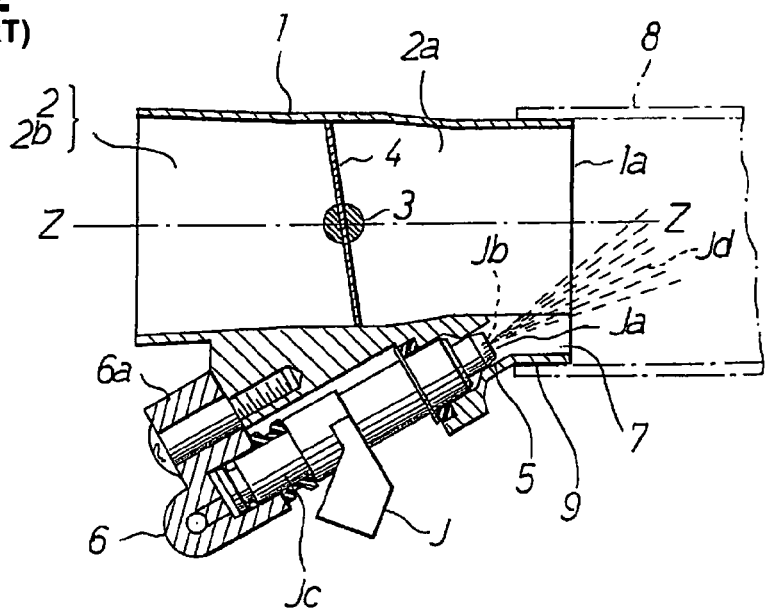
FIG. 2 (PRIOR ART)
FIG. 2 is a vertical sectional view of a conventional throttle body.
Figure 3:
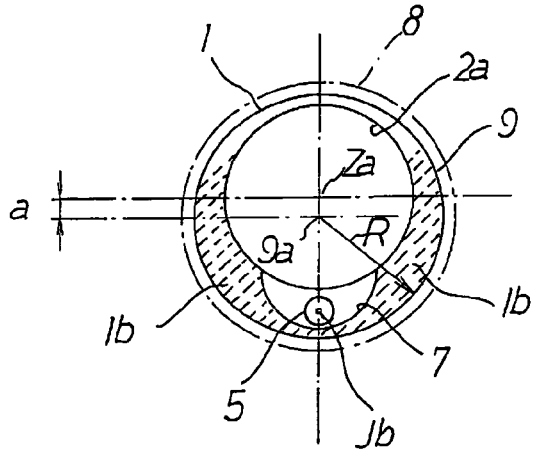
FIG. 3 (PRIOR ART)
FIG. 3 is a right side view of a main portion in FIG. 2.

In order to achieve the object mentioned above, in accordance with the present invention, there is provided a multiple throttle body for a two-wheeled vehicle in which a throttle body is formed by continuously forming a discharge opening hole structured such that a throttle valve shaft to which a throttle valve is attached is arranged so as to be rotatably supported across a suction air passage and an injection hole of a fuel injection valve is open toward the suction air passage in a downstream side than the throttle valve, and a fuel spray escaping hole toward an engine side end surface including the suction air passage in the downstream side of the throttle valve from the discharge opening hole, a plurality of the throttle bodies are arranged in a side direction, and throttle valve shafts of the respective throttle bodies are coaxially arranged in the side direction, wherein an engine side mounting pipe sleeve formed in an outer periphery of the downstream side suction air passage including at least the fuel spray escaping hole and the engine side end surface is formed in an oval shape or an elliptic shape, and short axis portions of the oval shape or the elliptic shape are arranged along a longitudinal axis of the throttle valve shaft.

In accordance with the multiple throttle body for the two-wheeled vehicle of the present invention, since the engine side mounting pipe sleeve of the throttle body is formed in the oval shape or the elliptic shape, and the short axis portions of the oval shape or the elliptic shape are arranged along the longitudinal axis of the throttle valve shaft, it is possible to shorten the side mounting pitch of the adjacent throttle bodies in correspondence to a difference between the diameter of the conventional engine side mounting pipe sleeve formed in the complete round shape and the length of the short axis portion of the present invention, whereby it is possible to widely shorten the total width along the longitudinal axis of the throttle valve shaft of the multiple throttle body.

Accordingly, it is possible to widely improve the freedom of layout and the mounting property to the two-wheeled vehicle.

Further, in accordance with the structure mentioned above, it is possible to make the thickness between the lower side including the side portion of the suction air passage and the engine side mounting pipe sleeve thin in correspondence to the length of the short axis portion of the engine side mounting pipe sleeve, whereby it is possible to improve the molding property at a time of injection molding of the throttle body in accordance with the aluminum die casting, it is possible to reduce the weight, it is possible to improve the mounting property to the two-wheeled vehicle, the freedom of layout and the productivity at a time of working and assembling, and it is possible to achieve the reduction of the material cost so as to reduce the manufacturing cost.

A description will be given of an embodiment of a multiple throttle body for a two-wheeled vehicle in accordance with the present invention with reference to FIG. 1.

Figure 4:
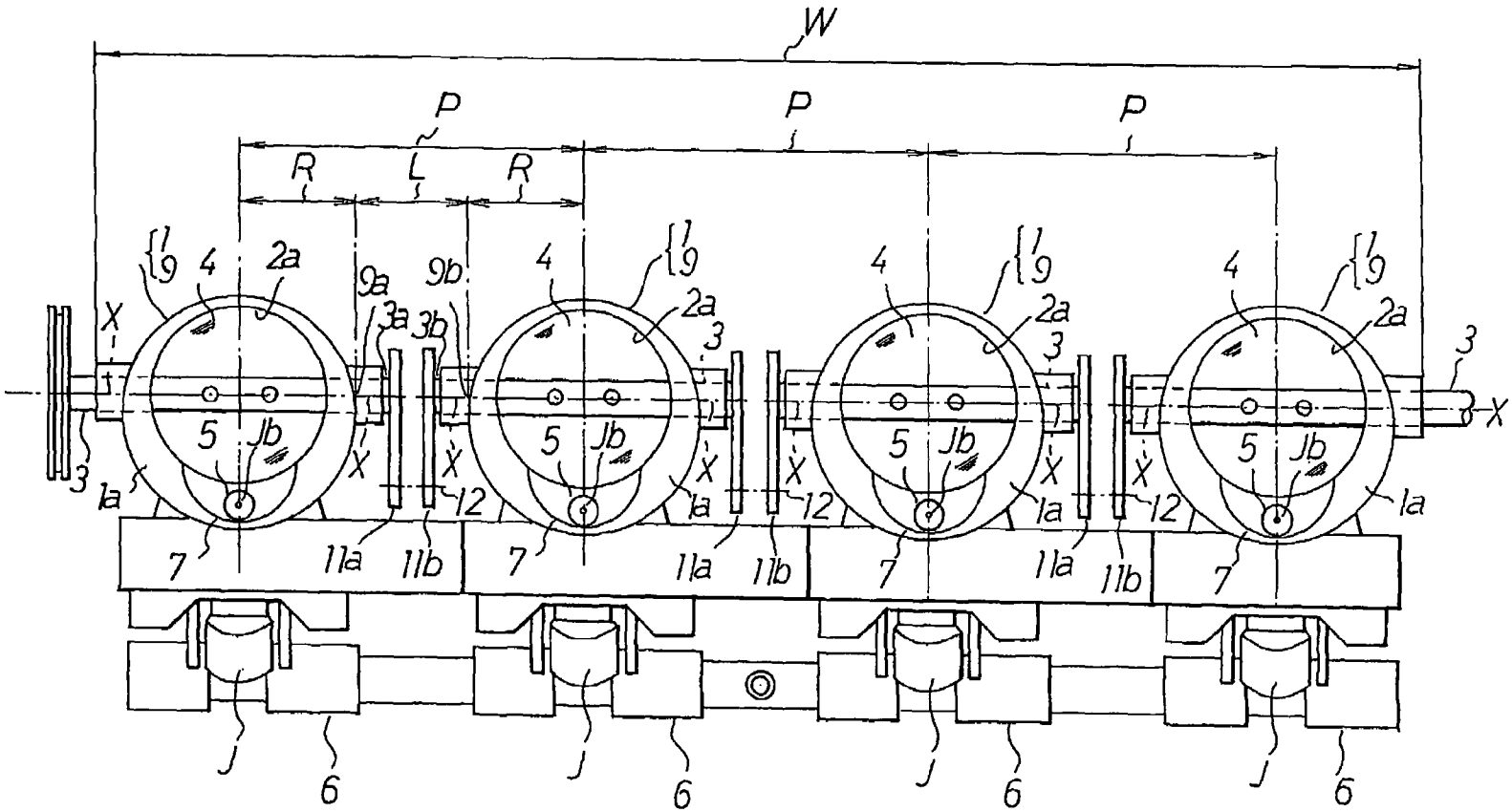
FIG. 4 (PRIOR ART)
FIG. 4 is a side view of a conventional multiple throttle body.

In this case, in FIG. 1, four throttle bodies, each of which is provided with a fuel injection valve, are arranged and fixed in a side direction in the same manner as FIG. 4, and in order to clarify a point of the present invention, there are mainly shown a suction air passage in each of the throttle bodies and an engine side mounting pipe sleeve.

In this case, in FIG. 1, four throttle bodies each provided with a fuel injection valve are arranged and fixed in a side portion in the same manner as FIG. 4, and in order to clarify a point of the invention, there are mainly shown a suction air passage and an engine side mounting pipe sleeve in each of the throttle bodies.

Further, a description of the same structure portions as those in FIG. 4 will be omitted by using the same reference numerals.

An engine side mounting pipe sleeve 10 is formed in an outer periphery of a suction air passage 2*a* in a downstream side than a throttle valve 4 of a throttle body 1.

A description will be given in more detail of the engine side mounting pipe sleeve 10. The engine side mounting pipe sleeve 10 is formed so as to surround the suction passage 2*a* in the downstream side than the throttle valve 4 including an engine side end surface 1*a* and at least an outer periphery of a fuel spray escaping hole 7, and a shape thereof is formed in an oval shape or an elliptic shape.

Further, a short axis portion 10*a* of the engine side mounting pipe sleeve 10 formed in the oval shape or the elliptic shape is particularly arranged along a longitudinal axis X-X of a throttle valve shaft 3.

In this case, a long axis portion 10*b* of the engine side mounting pipe sleeve 10 is arranged along a line Y-Y orthogonal to the longitudinal axis X-X of the throttle valve shaft 3.

Further, a length between the short axis portion and the perpendicular direction line Y-Y passing through a center Za of the suction air passage 2*a* is formed as S (in other words, the length S is a half of the short axis portion 10*a*). The length S is formed smaller than a radius R of the conventional engine side mounting pipe sleeve 10.

For example, the engine side mounting pipe sleeve 10 is formed in FIG. 1 in such a manner as to set a thickness h1 between an upper point 2*a*1 of the suction air passage 2*a* and an upper point 10*a*1 of the engine side mounting pipe sleeve 10, a thickness h2 between a right point 2*a*2 of the suction air passage 2*a* and a right point 10*a*2 of the engine side mounting pipe sleeve 10, a thickness h3 between a left point 2*a*3 of the suction air passage 2*a* and a left point 10*a*3 of the engine side mounting pipe sleeve 10 and a thickness h4 between a lower point 7*a* of the fuel spray escaping hole 7 and a lower point 10*a*4 of the engine side mounting pipe sleeve 10 to a predetermined thickness (for example, 2 mm).

In accordance with the structure in which the shape of the engine side mounting pipe sleeve is formed in the oval shape or the elliptic shape as mentioned above, and the short axis portion 10*a* thereof is arranged along the longitudinal axis X-X of the throttle valve shaft 3, the length S from the perpendicular direction line Y-Y of the suction air passage 2*a* to a facing side surface 10*c* (corresponding to the right point 10*a*2 of the engine side mounting pipe sleeve 10 mentioned above) of the engine side mounting pipe sleeve 10 can be formed shorter in correspondence to a difference (R−S) than the radius R of the conventional engine side mounting pipe sleeve 9.

More specifically, the radius R of the conventional engine side mounting pipe sleeve 9 is formed as 20.5 mm, the length S in the short axis portion 10*a* of the engine side mounting pipe sleeve 10 in accordance with the present invention is formed as 17 mm, and can be shortened by 3.5 mm corresponding to the difference between R and S in the radial direction of the engine side mounting pipe sleeve 10, and it is possible to shorten by 7 mm in the side mounting pitch P between the adjacent throttle bodies 1 and 1. In this case, the same gap L as the conventional one is employed as a gap L between the facing side surfaces 10*c* and 10*d* of the adjacent throttle bodies 1 and 1.

As mentioned above, since the side mounting pitch P between the adjacent throttle bodies 1 and 1 can be shortened in comparison with the conventional one, it is possible to shorten the total width W of the throttle bodies along the longitudinal axes X-X of the throttle valve shafts 3 of the multiple throttle body. Particularly, in the two-wheeled vehicle in which an accommodating space of the throttle body is limited to a narrow range, it is possible to increase a freedom of layout and it is possible to widely improve a mounting property.

Further, in accordance with the present invention, since it is possible to make the thicknesses h1, h2, h3 and h4 between the upper point 2*a*1, the right point 2*a*2 and the left point 2*a*3 of the suction air passage 2*a* and the lower point 7*a*1 of the fuel spray escaping hole 7, and the engine side mounting pipe sleeve 10 thin as mentioned above, it is possible to form the lower side of the suction air passage 2*a*, and the portion between the fuel spray escaping hole 7 and the engine side mounting pipe sleeve 10 (shown by a diagonal dotted line in FIG. 1) in a thin shape, whereby it is possible to effectively prevent the blow hole from being produced at a time of forming the throttle body 1 by aluminum.

Further, since the weight of the throttle body itself can be reduced, it is possible to improve a working property and an assembling property of the throttle body 1, it is possible to improve a mounting property particularly to the middle and small sized two-wheeled vehicle, and it is possible to reduce the material cost so as to suppress an increase of a manufacturing cost.

In this case, the specific numerical values mentioned above correspond to an example which is cited for easy understanding of the present invention, and the present invention is not limited by the numerical values.

Further, the present embodiment relates to the structure in which four throttle bodies are provided continuously, however, two-train, three-train and six train throttle bodies can be employed. Further, in accordance with the present invention, the engine side mounting pipe sleeve 10 is formed in the oval shape or the elliptic shape, however, since the rubber mount 8 is formed by the rubber material and formed in the tubular shape, the fitting connection between the rubber mount 8 and the engine side mounting pipe sleeve 10 is not affected. Further, since at least the engine side mounting pipe sleeves in the respective throttle bodies forming four trains are the same, the description is given only of the left throttle body, and a detailed description in the other throttle bodies is omitted.

What is claimed is:

1. A multiple throttle body for a two-wheeled vehicle in which a throttle body is formed by continuously forming a discharge opening hole structured such that a throttle valve shaft to which a throttle valve is attached is arranged so as to be rotatably supported across a suction air passage and an injection hole of a fuel injection valve is open toward the suction air passage in a downstream side of the throttle valve, and a fuel spray escaping hole toward an engine side end surface including the suction air passage in the downstream side of the throttle valve from the discharge opening hole, a plurality of said throttle bodies are arranged in a side direction, and throttle valve shafts of the respective throttle bodies are coaxially arranged in the side direction, wherein an engine side mounting pipe sleeve formed in an outer periphery of the downstream side suction air passage including at least the fuel spray escaping hole and the engine side end surface is formed in an oval shape or an elliptic shape, and short axis portions of said oval shape or the elliptic shape are arranged along a longitudinal axis of the throttle valve shaft.

* * * * *